US005288345A

United States Patent [19]

Ohhashi et al.

[11] Patent Number: 5,288,345

[45] Date of Patent: Feb. 22, 1994

[54] METHOD FOR TREATING SINTERED ALLOY

[75] Inventors: Tsuneaki Ohhashi, Ohgaki; Nobuo Tsuno, Kasugai; Takashi Harada, Nagoya, all of Japan

[73] Assignee: NGK Insulators, Inc., Japan

[21] Appl. No.: 859,859

[22] Filed: Mar. 30, 1992

[30] Foreign Application Priority Data

Apr. 26, 1991 [JP] Japan ..... 3-125516

[51] Int. Cl.[5] ..... C23C 8/16

[52] U.S. Cl. ..... 148/514; 148/285; 148/287

[58] Field of Search ..... 148/513, 514, 285, 287

[56] References Cited

U.S. PATENT DOCUMENTS 4,364,780 12/1982 Blanken ..... 148/285
4,915,751 4/1990 Vaneman et al. .

FOREIGN PATENT DOCUMENTS 8010587 5/1988 Australia .
0390321 10/1990 European Pat. Off. .
648602 3/1985 Fed. Rep. of Germany .
3419638 11/1985 Fed. Rep. of Germany .
3-1279 6/1986 Japan .
2-270904 11/1990 Japan .
2092621 8/1982 United Kingdom .
2159542 12/1985 United Kingdom .
2234530 2/1991 United Kingdom .

OTHER PUBLICATIONS

Patent Abstracts of Japan, unexamined applications C field, vol. 11, No. 106, Apr. 3, 1987 The Patent Office Japanese Government p. 15 C 414, Kokai No. 61-253358.

*Primary Examiner*—George Wyszomierski
*Attorney, Agent, or Firm*—Parkhurst, Wendel & Rossi

[57] ABSTRACT

A method for treating sintered alloy is disclosed by exposing a portion of the sintered alloy at a temperature ranging from about 800° C. to about 1300° C. under an atmosphere that contains an amount of water vapor corresponding to dew points ranging from about 30° C. to about 60° C. The method according to the present invention gives sintered alloy with a satisfactory protective layer that excels in smoothness and uniformity, and that prevents abnormal oxidation. Moreover, the method is especially useful to a sintered alloy having a complex structure and/or thin walls, such as a honeycomb structure.

5 Claims, No Drawings

METHOD FOR TREATING SINTERED ALLOY

BACKGROUND OF THE INVENTION AND DESCRIPTION OF THE PRIOR ART

This invention relates to a method for treating sintered alloy to form a protective layer on its surface. This method is especially useful for sintered alloy bodies having protrusions and depressions along their surfaces, and for sintered alloy bodies having complex structures and/or thin walls, such as a honeycomb structure.

To enhance corrosion resistance and lubrication ability, parts made of iron have undergone a water vapor treatment in which they are hold in pressurized steam at a temperature between about 500° C. and about 600° C. to form a coating of $Fe_3O_4$ on its surfaces. However, this coating does not function as a protective layer against oxidation in higher temperatures.

Methods for forming a heat-resistant coating have been disclosed by U.S. Pat. No. 4,915,751, Japanese Patent Publication No. 3-1279 (1991), and Japanese Patent Laid-Open No. 2-270904 (1990). U.S. Pat. No. 4,915,751 has disclosed a two-step method of treating a stainless foil at a temperature ranging from 900° C. to 960° C. and at a temperature ranging from 960° C. to 1000° C. to give an alumina whisker. Japanese Patent Publication No. 3-1279 (1991) has disclosed a method of treating a stainless steel foil containing Mg at a temperature ranging from 1000° C. to 1150° C. in vacuum or under a hydrogen atmosphere, and treating the resultant foil under a carbon dioxide atmosphere. Japanese Patent Laid-Open No. 2-270904 (1990) has disclosed a method of treating at a temperature ranging from 950° C. to 1350° C. under an oxidizing atmosphere such as air, oxygen, carbon dioxide, a mixture of hydrogen and water vapor, etc.

However, the method disclosed in U.S. Pat. No. 4,915,751 requires two steps of heat treatments that make temperature control difficult and that also increase an operational cost. The method disclosed in Japanese Patent Publication No. 3-1279 (1991) is applicable only to stainless steel containing magnesium. Moreover, it takes time in the surface treatment process. Both methods disclosed in U.S. Pat. No. 4,915,751 and Japanese Patent Publication No. 3-1279 (1991) are applied to poreless stainless steel manufactured by melting and subsequent rolling.

Though Japanese Patent Laid-Open No. 2-270904 (1990) has disclosed a method of surface treatment under an atmosphere of a mixture of hydrogen and water vapor, specific conditions of the surface treatment have not been disclosed. Moreover, the coating thus obtained does not have satisfactory durability.

SUMMARY OF THE INVENTION

According to the present invention, a method for treating sintered alloy is provided, which comprises standing a portion of sintered alloy at a temperature ranging from about 800° C. to about 1300° C. under an atmosphere that contains an amount of water vapor corresponding to dew points ranging from about 5° C. to about 60° C.

DESCRIPTION OF THE PREFERRED EMBODIMENT

The present inventors have studied eft surface treatment of sintered alloy having protrusions and depressions along its surfaces. Sintered alloy with a metal oxide coating formed under a dry atmosphere, we have found, is prone to abnormal local oxidation. In contrast, sintered alloy with a metal oxide coating formed under an atmosphere with water vapor, is not prone to abnormal oxidation.

Therefore, according to the method in the present invention sintered alloy is treated in a specific temperature range under an atmosphere with water vapor to form a metal oxide on its surfaces, which enhances oxidation resistance of the sintered alloy.

The method according to the present invention, involving a chemical reaction between gas and surface, is particularly useful to sintered alloy having protrusions and depressions along its surfaces, including sintered alloys having a complex structures and/or thin walls, such as a honeycomb structure.

According to the method in the present invention, a sintered alloy to be treated is required to contain Al and to have a melting point equal to or higher than a surface treatment temperature. Other elements in the sintered alloy are not particularly restricted, and at least one element is selected from the group consisted of Fe, Cr, B, Si, La, Ce, Cu, Sn, Y, Ti, Co, Ni, Ca, alkaline earth metals, lanthanides, Hf, and Zr.

The temperature range for surface treatment of the sintered alloy of the present invention is preferably from about 800° C. to about 1300° C., particularly from about 1000° C. to about 1200° C. When, sintered alloy is treated in temperatures lower than 800° C., an alumina protective layer formed contains so much iron that its ability for oxidation resistance deteriorates. On the other hand when the sintered alloy is treated in temperatures higher than 1300° C., a rate of oxidation on its surfaces during the surface treatment is too rapid to form a uniform protective layer, resulting in abnormal oxidation and in deterioration of mechanical strength due to grain growth.

An amount of water vapor in an atmosphere which the sintered alloy is treated under preferably corresponds to dew points equal to or lower than 60° C. Too much water vapor makes the sintered alloy prone to corrosion during the treatment, and results in deterioration in oxidation resistance and corrosion resistance of the treated sintered alloy. On the other hand too small amount of water vapor prohibits formation of a uniform coating on the sintered, results in local oxidation, and deteriorates oxidation resistance and corrosion resistance of the treated sintered alloy Thus an amount of water vapor in an atmosphere under which the sintered alloy is treated preferably corresponds to dew points equal to or higher than 5° C., particularly equal to or higher than 15° C.

Considering the cost of equipment, an amount of water vapor in an atmosphere preferably corresponds to dew points equal to or lower than 40° C. Favorably, an amount of water vapor in an atmosphere is equal to or less than the amount of saturated water vapor around the equipment at a temperature in the surroundings. When an atmosphere for surface treatment of sintered alloy essentially consists of mixture of hydrogen, oxygen, or a mixture of oxygen and nitrogen, an amount of water vapor preferably corresponds to dew points equal to or higher than 30° C.

An atmosphere for surface treatment of sintered alloy is not particularly restricted, and hydrogen, inert gas, air, oxygen and so on are used. Hydrogen or Inert gas is a preferable atmosphere. One possible explanation for this preference is that the absolute amount of oxygen contained in such an atmosphere is smaller than the other atmospheres, and oxidation due to water vapor is presumed to become a dominant oxidation process.

Surface treatment time of sintered alloy is preferably equal to or longer than 30 minutes, particularly equal to or longer than one hour. Too short of a treatment time results in deterioration of protective ability of the protective layer thus formed due to destabilization at the interface between the coating and matrix. Due to a cost factor, time for surface treatment is preferably equal to or less than 10 hours, particularly equal to or less than five hours.

As disclosed above, temperature and an amount of water vapor in an atmosphere for surface treatment of sintered alloy considerably affect formation of a coating on the surfaces of the sintered alloy, and other conditions such as an atmosphere and surface treatment time also affect formation of a coating. Though it is not clear how water vapor in an atmosphere for surface treatment plays a role for the formation of a protective layer, some form of hydrogen that may be produced by oxidation of aluminum by water is presumed somehow to help form uniform coating.

As disclosed above, the method according to the present invention gives sintered alloy with a satisfactory protective layer that excels in smoothness and uniformity, and that prevents abnormal oxidation. As a result, the method according to the present invention gives metallic materials that excel in oxidation resistance in high temperatures and corrosion resistance.

Moreover, it is quite feasible to control an amount of water in an atmosphere corresponding to dew points equal to or higher than 5° C., the method is useful in its industrial application.

EXAMPLES

The present invention is disclosed in more detail but it shall not be limited to the following examples.

EXAMPLE 1

Sintered alloy having a composition of Fe-20Cr-5Al (% by weight) with a porosity of 26% was prepared from Fe powders, Fe-50Al powders, and Fe-60Cr powder s as starting materials, and fired at 1320° C. The above sintered alloy was used as samples for surface treatment under various conditions to form coatings, as tabulated in Table 1.

Each of the samples of the coated sintered alloy underwent an oxidation resistance test. An amount of total oxidation of each sample was measured after the test, and presence or absence of abnormal oxidation was observed. These results are also tabulated in Table 1.

In the oxidation resistance test a sample was held at 980° C. for 700 hours in an electric furnace, and then weight increase and dimension changes were measured to evaluate the oxidation resistance of the sample. An amount of total oxidation of a sample refers to the sum of weight increase during the surface treatment of the sample and weight increase during the oxidation resistance test of the sample.

TABLE 1

| | Comparative Example | Example | | | | | | Comparative Example | | |
|---|---|---|---|---|---|---|---|---|---|---|
| Run No. | 1 | 2 | 3 | 4 | 5 | 6 | 7 | 8 | 9 | 10 |
| Conditions of treatment | | | | | | | | | | |
| Temperature of keeping (°C.) | 500 | 800 | 1000 | 1000 | 1150 | 1150 | 1200 | 1300 | 1000 | 500 |
| Time of keeping (h) | 5 | 5 | 5 | 5 | 2 | 2 | 1 | 5 | 0.5 | 5 |
| Introduced gas | Hydrogen | Hydrogen | Hydrogen | Hydrogen | Hydrogen | Hydrogen | Hydrogen | Hydrogen | Hydrogen | Argon |
| Dew point (°C.) | 20 | 30 | 30 | 40 | 40 | 50 | 40 | 40 | 2 | 20 |
| Weight increase by preliminary oxidation (wt %) | 0.1 | 0.5 | 0.9 | 1.1 | 1.6 | 2.0 | 1.4 | 5.2 | 0.4 | 0.2 |
| Oxidation resistance (980° C. × 700 h) | | | | | | | | | | |
| Weight increase (wt %) | 6.6 | 3.9 | 2.0 | 1.7 | 1.1 | 2.7 | 2.2 | 5.5 | 12.9 | 7.2 |
| Dimensional change (dim %) | 4.0 | 1.7 | 0.8 | 0.7 | 0.4 | 1.3 | 0.9 | 3.9 | 9.0 | 4.0 |
| Total oxidation amount (wt %) | 6.7 | 4.4 | 2.9 | 2.8 | 2.7 | 4.7 | 3.6 | 10.7 | 13.2 | 7.4 |
| Abnormal oxidation | Present | Absent | Absent | Absent | Absent | Absent | Absent | Present | Many | Present |

| | Example | | | | | | Comparative Example | |
|---|---|---|---|---|---|---|---|---|
| Run No. | 11 | 12 | 13 | 14 | 15 | 16 | 17 | 18 |
| Conditions of treatment | | | | | | | | |
| Temperature of keeping (°C.) | 800 | 1000 | 1000 | 1150 | 1200 | 1200 | 1300 | 800 |
| Time of keeping (h) | 5 | 5 | 5 | 1 | 2 | 0.5 | 3 | 5 |
| Introduced gas | Argon | Argon | Argon | Argon | Argon | Argon | Argon | Argon |
| Dew point (°C.) | 20 | 10 | 20 | 20 | 5 | 40 | 20 | −23 |
| Weight increase by preliminary oxidation (wt %) | 0.7 | 0.9 | 1.1 | 1.2 | 2.2 | 2.1 | 5.1 | 0.4 |
| Oxidation resistance (980° C. × 700 h) | | | | | | | | |
| Weight increase (wt %) | 3.8 | 2.1 | 1.8 | 1.4 | 3.1 | 2.9 | 5.3 | 8.1 |
| Dimensional change (dim %) | 1.8 | 0.9 | 0.6 | 0.6 | 1.5 | 1.4 | 3.6 | 5.3 |
| Total oxidation amount (wt %) | 4.5 | 3.0 | 2.9 | 2.6 | 5.3 | 5.0 | 10.4 | 8.6 |
| Abnormal oxidation | Absent | Absent | Absent | Absent | Absent | Absent | Present | Many |

EXAMPLE 2

Sintered alloy having a composition of Fe-26Al (% by weight) with a porosity of 35% was prepared from Fe powders and Fe-50Al powders as starting materials, and fired at 1250° C. The above sintered alloy was used as samples for surface treatment under various conditions to form coatings, as tabulated in Table 2.

Each of the samples of the coated sintered alloy underwent an oxidation resistance test, as in Example 1.

An amount of total oxidation of each sample was measured after the test, and presence or absence of abnormal oxidation was observed, as Example 1. These results are also tabulated in Table 2.

TABLE 2

| Run No. | Comparative Example 19 | Example 20 | 21 | 22 | 23 | 24 | Comparative Example 25 | 26 | 27 |
|---|---|---|---|---|---|---|---|---|---|
| Conditions of treatment | | | | | | | | | |
| Temperature of keeping (°C.) | 500 | 800 | 1000 | 1000 | 1150 | 1200 | 1000 | 1000 | 500 |
| Time of keeping (h) | 5 | 5 | 5 | 5 | 1 | 1 | 0.5 | 5 | 5 |
| Introduced gas | Hydrogen | Hydrogen | Hydrogen | Hydrogen | Hydrogen | Hydrogen | Hydrogen | Hydrogen | Nitrogen |
| Dew point (°C.) | 30 | 30 | 30 | 40 | 40 | 50 | 2 | 80 | 30 |
| Weight increase by preliminary oxidation (wt %) | 0.2 | 0.7 | 1.5 | 1.6 | 1.7 | 2.0 | 0.7 | 3.0 | 0.4 |
| Oxidation resistance (980° C. × 700 h) | | | | | | | | | |
| Weight increase (wt %) | 6.3 | 3.4 | 1.1 | 1.0 | 1.3 | 2.7 | 13.1 | 5.0 | 6.3 |
| Dimensional change (dim %) | 4.0 | 1.6 | 0.5 | 0.4 | 0.6 | 1.2 | 8.0 | 3.7 | 3.8 |
| Total oxidation amount (wt %) | 6.5 | 4.1 | 2.6 | 2.6 | 3.0 | 4.7 | 13.8 | 8.0 | 6.7 |
| Abnormal oxidation | Present | Absent | Absent | Absent | Absent | Absent | Many | Many | Present |

| Run No. | Example 28 | 29 | 30 | 31 | 32 | 33 | 34 | Comparative Example 35 | 36 |
|---|---|---|---|---|---|---|---|---|---|
| Conditions of treatment | | | | | | | | | |
| Temperature of keeping (°C.) | 800 | 1000 | 1000 | 1150 | 1150 | 1150 | 1200 | 1000 | 1100 |
| Time of keeping (h) | 5 | 5 | 5 | 2 | 2 | 2 | 2 | 0.4 | 5 |
| Introduced gas | Nitrogen | Nitrogen | Nitrogen | Nitrogen | Nitrogen | Nitrogen | Nitrogen | Nitrogen | Nitrogen |
| Dew point (°C.) | 30 | 30 | 15 | 5 | 40 | 60 | 15 | −26 | 70 |
| Weight increase by preliminary oxidation (wt %) | 0.7 | 1.5 | 1.1 | 2.0 | 1.8 | 2.3 | 1.8 | 0.4 | 10.8 |
| Oxidation resistance (980° C. × 700 h) | | | | | | | | | |
| Weight increase (wt %) | 4.1 | 2.3 | 1.9 | 2.9 | 0.6 | 2.7 | 1.1 | 22.6 | 9.0 |
| Dimensional change (dim %) | 1.9 | 1.0 | 0.7 | 1.4 | 0.2 | 1.2 | 0.4 | 15.7 | 6.1 |
| Total oxidation amount (wt %) | 4.8 | 2.8 | 3.0 | 4.9 | 2.8 | 5.0 | 2.9 | 23.0 | 19.8 |
| Abnormal oxidation | Absent | Absent | Absent | Absent | Absent | Absent | Absent | Many | Many |

EXAMPLE 3

Sintered alloy having a composition of Fe-20Cr-5Al-3Si-0.05B (% by weight) with a porosity of 5% is prepared from Fe powders, Fe-50Al powders, Fe-20B powders, Cr powders, and Fe-75Si powders as starting materials, and fired at 1300° C. The above alloy was used as samples for surface treatment under various conditions to form coatings, as tabulated in Table 3.

Each of the samples of the coated sintered alloy underwent an oxidation resistance test, as in Example 1. An amount of total oxidation of each sample was measured after the test, and presence or absence of abnormal oxidation was observed, as Example 1. These results are also tabulated in Table 3.

TABLE 3

| Run No. | Example 37 | 38 | 39 | 40 | 41 | 42 | Comparative Example 43 | 44 | 45 | 46 |
|---|---|---|---|---|---|---|---|---|---|---|
| Conditions of treatment | | | | | | | | | | |
| Temperature of keeping (°C.) | 1100 | 1100 | 1100 | 1100 | 1100 | 1100 | 1200 | 1380 | 1200 | 500 |
| Time of keeping (h) | 5 | 5 | 5 | 5 | 10 | 5 | 5 | 5 | 10 | 10 |
| Introduced gas | Hydrogen | Nitrogen | Argon | Oxygen | Oxygen | Oxygen | Oxygen | Oxygen | Oxygen | $N_2$ 80 $O_2$ 20 |
| Dew point (°C.) | 30 | 30 | 30 | 30 | 30 | 60 | −37 | 25 | 70 | 30 |
| Weight increase by preliminary oxidation (wt %) | 1.1 | 1.6 | 1.4 | 2.1 | 2.5 | 2.5 | 2.8 | 15.0 | 13.3 | 0.3 |
| Oxidation resistance (980° C. × 700 h) | | | | | | | | | | |
| Weight increase (wt %) | 1.1 | 0.8 | 0.9 | 3.0 | 2.6 | 3.3 | 5.1 | 7.0 | 5.1 | 7.0 |
| Dimensional change (dim %) | 0.5 | 0.3 | 0.4 | 1.3 | 1.2 | 1.1 | 3.3 | 4.6 | 3.5 | 3.8 |
| Total oxidation amount (wt %) | 2.2 | 2.4 | 2.3 | 5.1 | 5.1 | 5.8 | 8.9 | 22.0 | 18.4 | 7.3 |
| Abnormal oxidation | Absent | Absent | Absent | Absent | Absent | Absent | Many | Present | Many | Present |

| Run No. | Example 47 | 48 | 49 | 50 | 51 | Comparative Example 52 | 53 |
|---|---|---|---|---|---|---|---|
| Conditions of treatment | | | | | | | |
| Temperature of keeping (°C.) | 800 | 1100 | 1150 | 1150 | 1200 | 1200 | 1350 |
| Time of keeping (h) | 5 | 5 | 5 | 1 | 1 | 2 | 10 |
| Introduced gas | $N_2$ 80 $O_2$ 20 | $N_2$ 80 $O_2$ 20 | $N_2$ 80 $O_2$ 20 | $N_2$ 80 $O_2$ 20 | $N_2$ 80 $O_2$ 20 | $N_2$ 80 $O_2$ 20 | $N_2$ 80 $O_2$ 20 |
| Dew point (°C.) | 30 | 50 | 30 | 30 | 40 | −29 | 30 |
| Weight increase by preliminary oxidation (wt %) | 0.7 | 2.3 | 2.2 | 2.0 | 2.2 | 2.6 | 4.2 |
| Oxidation resistance (980° C. × 700 h) | | | | | | | |

TABLE 3-continued

| | | | | | | | |
|---|---|---|---|---|---|---|---|
| Weight increase (wt %) | 4.5 | 2.9 | 2.7 | 2.9 | 2.5 | 5.1 | 6.3 |
| Dimensional change (dim %) | 1.7 | 1.4 | 1.2 | 1.3 | 1.1 | 3.9 | 3.6 |
| Total oxidation amount (wt %) | 5.2 | 5.2 | 4.9 | 4.9 | 4.7 | 8.7 | 10.5 |
| Abnormal oxidation | Absent | Absent | Absent | Absent | Absent | Many | Present |

As shown in the results in Tables 1, 2, and 3, when a sample of sintered alloy had surface treatment in which the sample was held in a temperature ranging from about 800° C. to about 1300° C. under an atmosphere that contains an amount of water vapor corresponding to dew points ranging from about 5° to about 60° C., the sample had superior oxidation resistance and did not undergo abnormal oxidation.

What is claimed is:

1. A method for treating sintered alloy, comprising: exposing at least a portion of a sintered alloy containing aluminum to a temperature within a range from about 800° C. to about 1,300° C. under an atmosphere which contains an amount of water vapor corresponding to a dew point within the range of about 30° C. to about 60° C.

2. The method of claim 1, wherein said atmosphere consists essentially of said water vapor and hydrogen.

3. The method of claim 1, wherein said amount of water vapor corresponds to a dew point within a range of about 30° C. to about 40° C.

4. The method of claim 3, wherein said atmosphere consists essentially of said water vapor and oxygen, or of said water vapor and a mixture of oxygen and nitrogen.

5. The method of claim 1, wherein said temperature is within a range from about 1,000° C. to about 1,200° C.

* * * * *

UNITED STATES PATENT AND TRADEMARK OFFICE

CERTIFICATE OF CORRECTION

PATENT NO. : 5,288,345
DATED : February 22, 1994
INVENTOR(S) : Tsuneaki Ohhashi, et. al.

It is certified that error appears in the above-indentified patent and that said Letters Patent is hereby corrected as shown below:

On the Title page, item [73], Assignee: should read -- NGK Insulators, Ltd. Japan --.

Signed and Sealed this

Twenty-eighth Day of June, 1994

Bruce Lehman

*Attest:*

BRUCE LEHMAN

*Attesting Officer*

*Commissioner of Patents and Trademarks*